United States Patent [19]

Paulson

[11] 4,111,120

[45] Sep. 5, 1978

[54] TWO COLOR SWING-AWAY PRESS

[76] Inventor: Harold E. Paulson, 5369 Vernon Lake Dr., Dunwoody, Ga. 30338

[21] Appl. No.: 808,058

[22] Filed: Jun. 20, 1977

Related U.S. Application Data

[63] Continuation-in-part of Ser. No. 731,711, Oct. 12, 1976, abandoned.

[51] Int. Cl.[2] ..... B41F 5/02; B41F 13/12; B41F 13/44

[52] U.S. Cl. ..... 101/175; 101/177; 101/247

[58] Field of Search ..... 101/136, 137, 139, 140, 101/143, 144, 174, 175, 177, 184, 185, 216, 217, 218, 247, 248, 93.28, 349, 212

[56] References Cited

U.S. PATENT DOCUMENTS

| | | | |
|---|---|---|---|
| 1,164,212 | 12/1915 | Reifsnyder et al. | 101/216 |
| 2,158,701 | 5/1939 | Jirousek | 101/137 |
| 2,533,012 | 12/1950 | Huckins | 101/175 |
| 2,860,578 | 11/1958 | Tregay | 101/248 |
| 2,896,536 | 7/1959 | Sauerman | 101/175 |
| 3,014,421 | 12/1961 | Townsend | 101/248 X |
| 3,521,559 | 7/1970 | Seseck et al. | 101/137 |
| 3,598,045 | 8/1971 | Miller | 101/93.28 |
| 3,738,265 | 6/1973 | Saueressig | 101/351 X |

FOREIGN PATENT DOCUMENTS

| | | | |
|---|---|---|---|
| 789,782 | 11/1935 | France | 101/349 |

*Primary Examiner*—J. Reed Fisher
*Attorney, Agent, or Firm*—Neil B. Schulte

[57] ABSTRACT

A two color printing press in which the plate cylinder for the second color and the ink supply rollers therefor are mounted in a pivoting frame which can be manually rotated away from the printing press to afford easy access to the interior of the press. Gear position indicators permit prealignment of the second color plate cylinder and rollers when they are swung into position.

7 Claims, 16 Drawing Figures

TWO COLOR SWING-AWAY PRESS

BACKGROUND OF THE INVENTION

This application is a continuation-in-part of applicant's prior copending application Ser. No. 731,711, filed Oct. 12, 1976, now abandoned.

Printing presses usually operate to deliver ink and water through a series of rollers to a plate cylinder which has an image chemically impressed thereon. The image picks up ink and upon the revolution of the plate cylinder the ink is deposited onto a blanket cylinder which in turn transfers the ink to paper or other stock which is passing between the blanket cylinder and an impression cylinder. In order to print a second color it is necessary to employ another ink and water supplied plate cylinder in contact with the blanket cylinder.

In the prior art, this second plate cylinder occupies a great deal of the remaining exposed surface of the balnket cylinder so as to prevent easy access to the blanket or plate cylinders for changing or adjusting of the various components. Consequently, it has been advantageous to mount the second color plate cylinder with its ink and water supply rollers on a separate frame which is movable. The machine operator must reach between the separated rollers in order to work, which action is clumsy and inconvenient. The operator's clothes often become soiled by contact with the machine. It usually takes a great deal of time to change plates causing an excessive amount of shut down time for an expensive printing press. The present invention avoids these difficulties by providing a unique swing out mechanism for the second plate cylinder, ink and water supply, and roller assembly, thus making the component parts more easily accessible and the entire machine more compact as described below.

SUMMARY OF THE INVENTION

Briefly, the present invention contemplates mounting the second color plate cylinder roller and ink and water supply rollers on a swinging frame, pivoted at one corner about a nearly vertical axis positioned a short distance away from both the first and second plate cylinders. A gear mounted on the end of the pivoted cylinders nearest the pivot axis swings into engagement with a driving gear mounted on the stationary part of the press on the side nearest the pivot axis so as to provide motive power to the second color cylinder and its accompanying supply rollers.

Since the gears are positioned at the pivot axis side they do not obstruct visibility or soil the operator's clothes with grease as they would if the operator had to work around gears mounted on the outside. Also there is no possibility of damaging plates which must be moved past outside mounted gears which have sharp teeth. However, the gears must mesh perfectly when the press is closed to assure proper registration and this is difficult with gears near the pivot axis since the gears can not be seen when the press is closed. To solve this problem a unique gear position indicator is provided on the outside of the press to permit prealignment of the gears before engagement.

As the moving frame swings shut it comes to rest on top of a bearing block at the outside of the press which controls vertical position, registration, and alignment. The moving frame also contacts an adjustable stop at the outside which controls the plate to plate position, pressure, and parallelism. Thus, alignment is not determined by the contact of the gears which could change with gear wear. However, the moving frame is very heavy, five to six hundred pounds is typical, and thus drops suddenly when moved off the bearing block. Also to close the frame it must be swung with some momentum so tha it bumps up onto the bearing block. Since the water is supplied from a shallow pan on the moving frame, spillage could be a nuisance except for a novel improvement in my invention wherein the vertical swing axis is tilted slightly. This tilt causes the frame to rise up as it swings with the high point just before the bearing block so that the frame comes down smoothly onto the bearing block.

Thus, it is an object of the present invention to provide an improved two color printing press that is more visible, and more easily accessible for maintenance and replacement. It is another object of my invention to provide a movable second color unit with a smooth movement that does not spill water or cause wear. Further features and advantages will become apparent upon consideration of the following description and drawings.

DESCRIPTION OF THE PREFERRED EMBODIMENT

Figure 1:
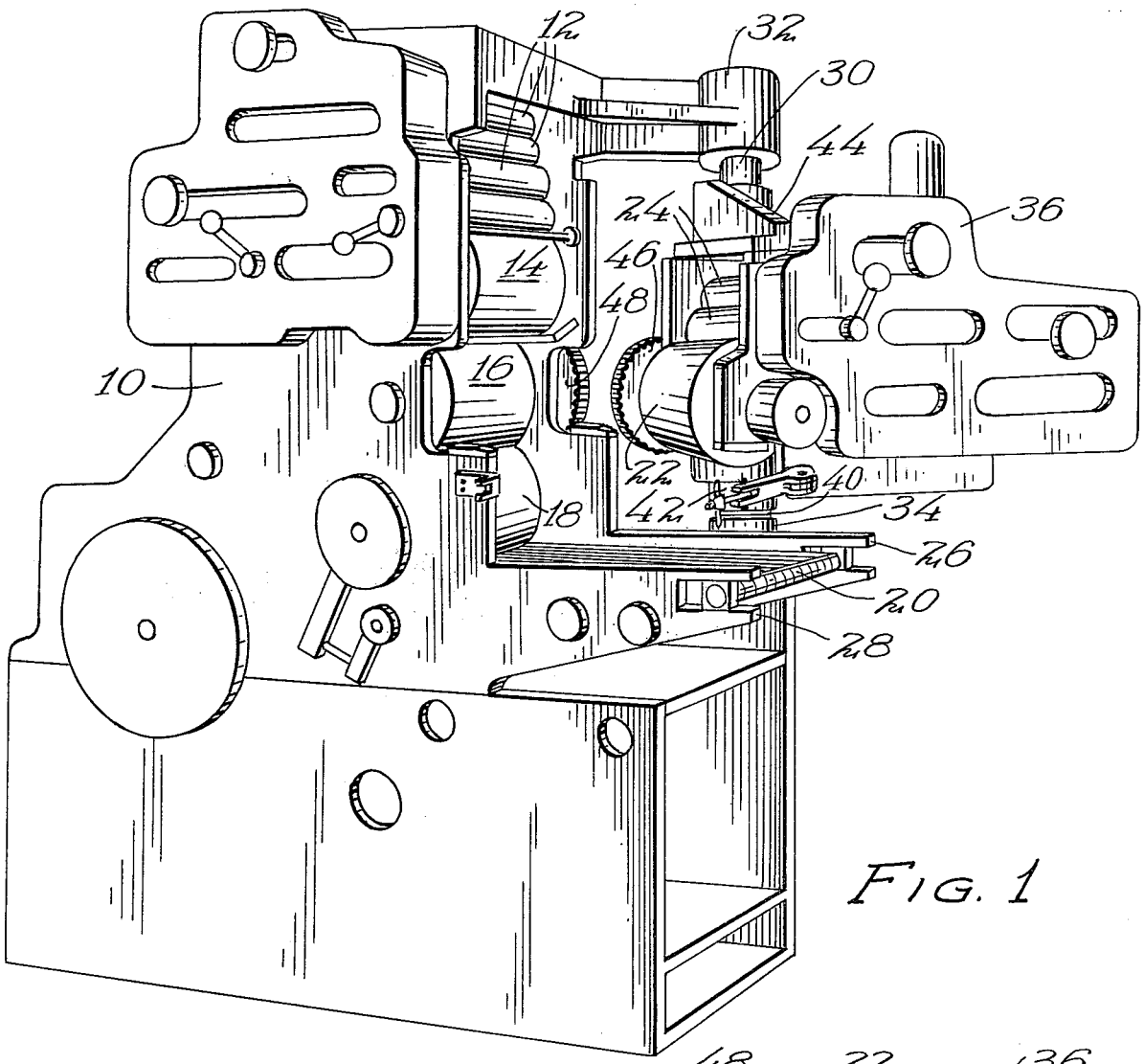
FIG. 1 is a perspective view of one embodiment of the present invention showing the second color cylinder and associated apparatus in a disengaged position pivoted away from the first color cylinder and the blanket cylinder.

In FIG. 1 a simplified two color printing press is displayed in perspective. Positioned within printing press 10 are a series of ink and water supply rollers 12, a first color plate cylinder 14, a blanket cylinder 16, and an impression cylinder 18. The image to be printed is formed chemically on plate cylinder 14 where it picks up ink from supply cylinders 12. The ink image is transferred onto blanket cylinder 16 and then transferred onto paper stock passing between blanket cylinder 16 and impression cylinder 18. A conveyor belt 20 helps carry the printed material out of the printing press.

In order to print a second color onto the paper stock a second plate cylinder 22 is provided which must be brought into contact with blanket cylinder 16. A number of ink and water supply rollers 24 feed second color plate cylinder 22. A nearly vertical pivot shaft 30 is mounted between an overhead extension 32 and a base pedestal 34 to support a frame assembly 36 which contains cylinder 22 and supply rollers 24. Frame 36 is carried top and bottom by a pair of arm members 44 and 42 which pivot about shaft 30. Arm member 42 rests on a roller bearing 40 which is supported by pedestal base 34. When frame 36 reaches the closed position with plate cylinder 22 against blanket cylinder 16 a gear 46 connected to the end of cylinder 22 engages a gear 48 connected to the end of cylinder 16 so that driving power is transmitted to the movable frame unit cylinders. Gears 46 and 48 are mounted at the side nearest the pivot axis so that they do not block access to the cylinders.

Figure 2:
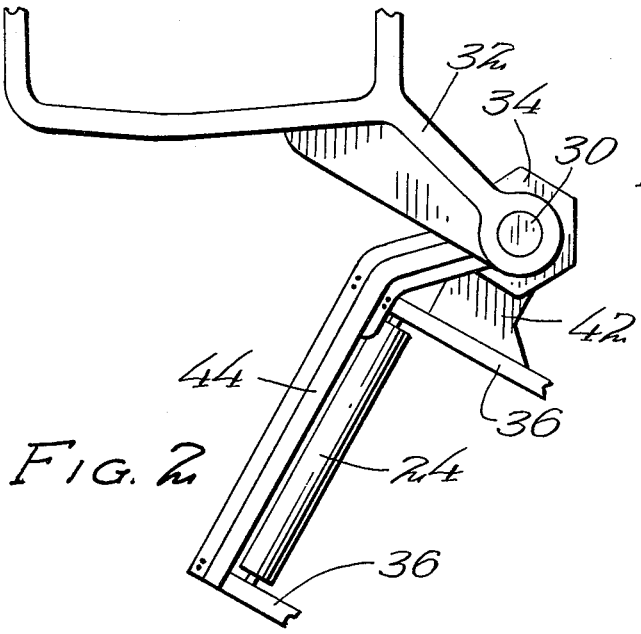
FIG. 2 is an overhead fragmentary view of the main frame of the press, the pivot shaft, and the pivoting frame.

In FIG. 2 it is more apparent how arm members 42 and 44 extend to the bottom and top of swinging frame 36. Arms 42 and 44 pivot about shaft 30 which is carried by base pedestal 34 and an extended arm 32. The position of shaft 30 is displaced about two feet from the corner of the swinging frame 36 so as to achieve a displaced opening effect when frame 36 is swung away from the main portion of the printing press. A closer pivot point would keep one side of cylinder 22 too close to blanket cylinder 16 to afford easy access thereto by the machine operator.

Figure 3:
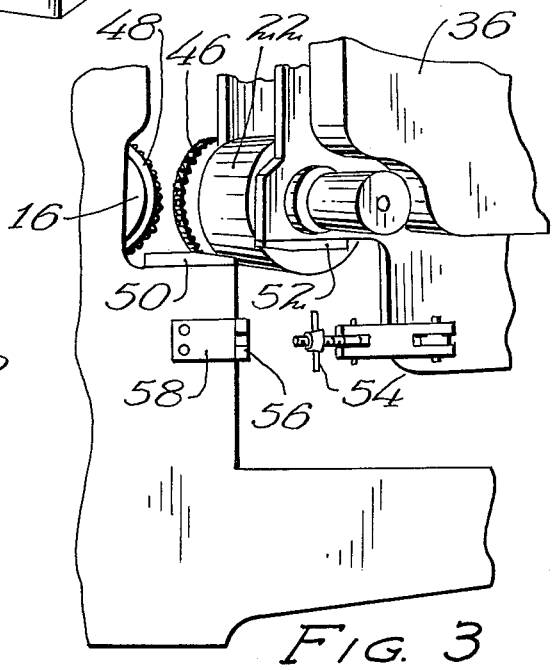
FIG. 3 is a partially cut away side view of the press showing an alignment block and locking latch.

In FIG. 3 a side view of the printing press showing the swinging frame 36 nearly closed is presented. The exact positioning of plate cylinder 22 against blanket cylinder 16 and the proper engagement of gears 46 and 48 is insured by a pair of beveled alignment blocks 50 and 52. As frame 36 swings into the closed position block 52 slides over the surface of block 50 so as to index the entire frame into the precise correct position. Frame 36 is locked into place by inserting a T-shaped locking bar 54 into a slot 56 in a bracket 58, thus insuring that the swinging frame 36 does not pivot away and disengage the mechanism during operation.

Figure 4:
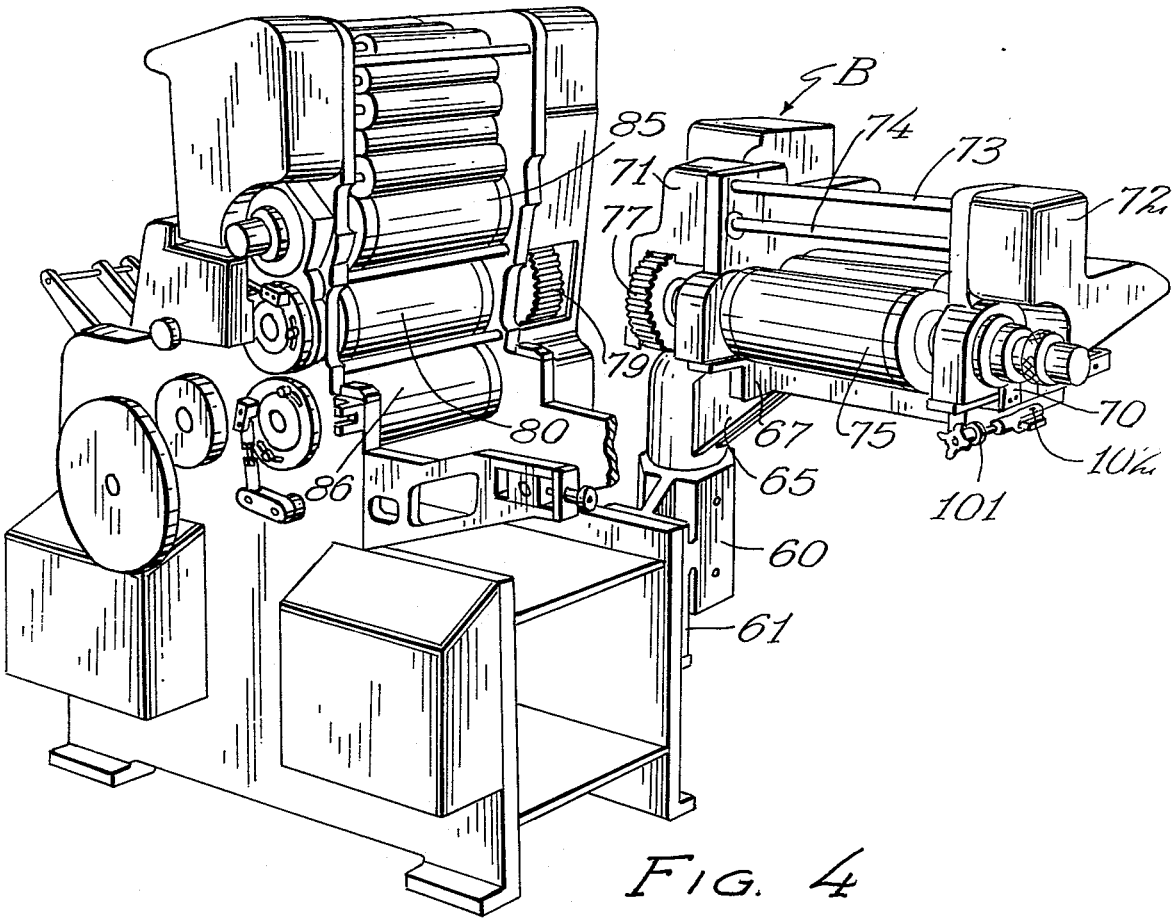
FIG. 4 is a perspective view of another embodiment showing the second color unit swung away from the press.
Figure 5:
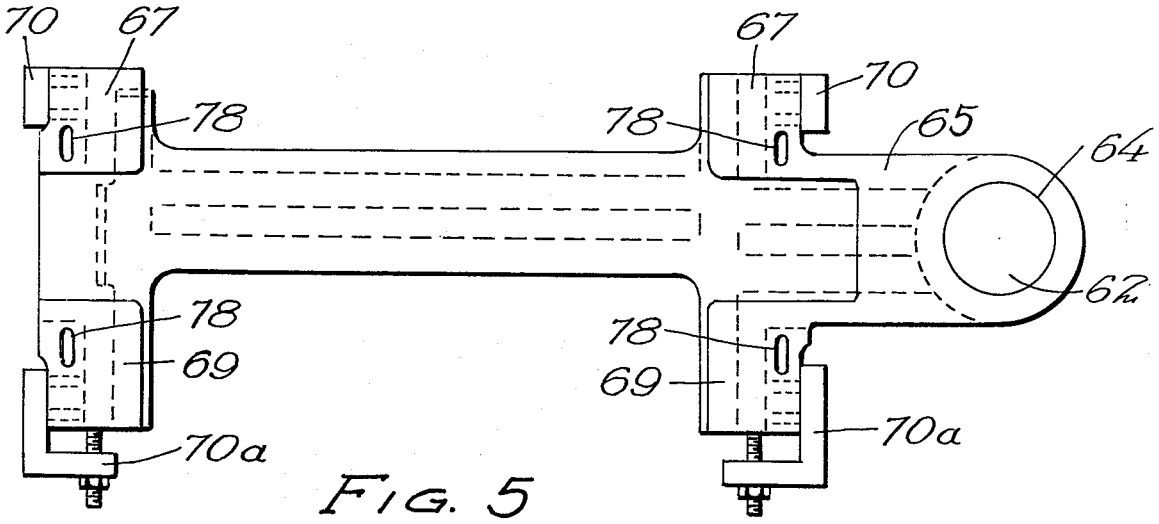
FIG. 5 is a plan view of the movable frame support table for the embodiment of FIG. 4.
Figure 10:
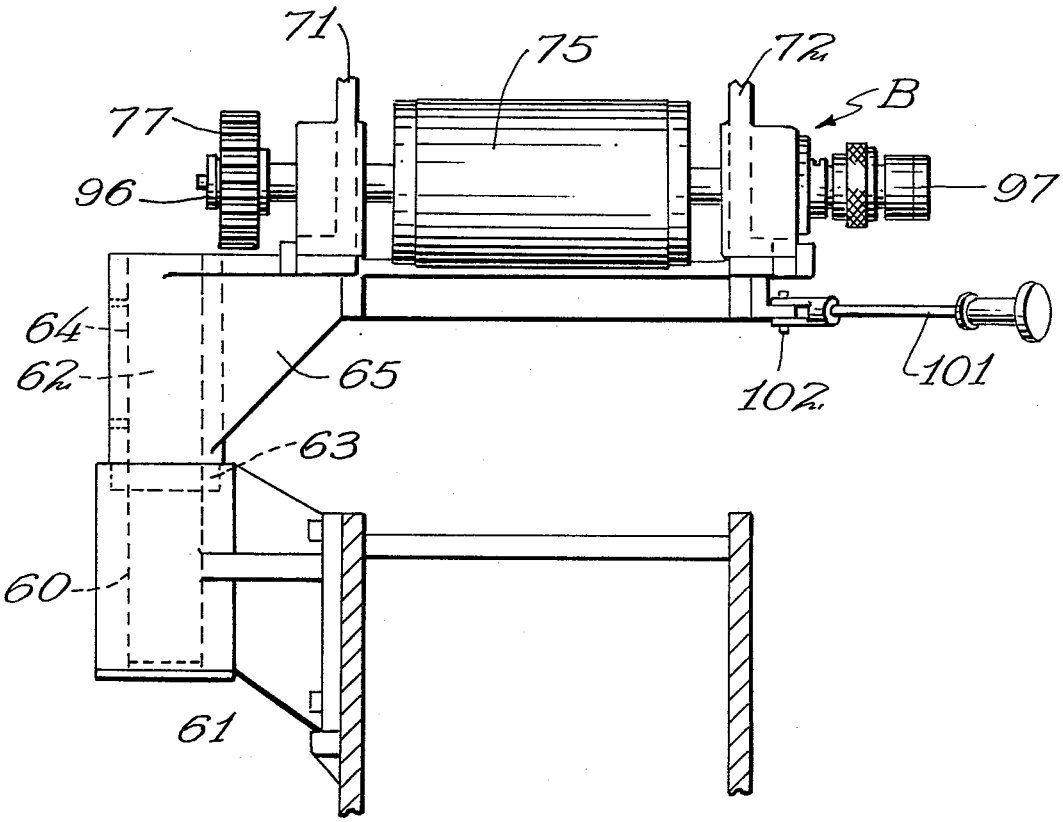
FIG. 10 is an elevational detail view of the added color unit in the embodiment of FIG. 4.

In FIGS. 4 and 10 another embodiment in which the second color unit is swung away is shown. The second color unit B is provided with a stub shaft 62 which extends downward into a socket 60 mounted to the fixed frame with a bracket 61. The shaft 62 is held in a cylindrical opening 64 in a mounting bracket 65 for the second color unit which rests on a thrust bearing ring 63. Mounting bracket 65 includes a support table as shown in FIG. 5. The support table comprises extensions 67 and 69 which extend at right angles to the longitudinal axis of the support table. Four brackets numbered 70 and **70*a* engage opposite ends of the second color unit B to hold it securely in place. Brackets 70 and 70*a*** hold the entire second color unit from movement along the support table.

As indicated in FIG. 4, a pair of opposed frame members 71 and 72 are mounted on opposite ends of the support table. Frame members 71 and 72 are held in proper parallel relation by shafts 73 and 74, as well as by the plate cylinder 75, and its supporting shaft 76. A gear 77 is mounted on the shaft 76 and is engageable with a gear 79 on the shaft of the blanket cylinder 80. Again the gears are near the pivot axis to increase accessibility. Returning to FIG. 5 four slots 78 are shown which are provided to adjustably attach frame members 71 and 72 in proper relation to engage the cylinders and gears when the second color unit B is moved into contact with the fixed unit.

Figure 7:
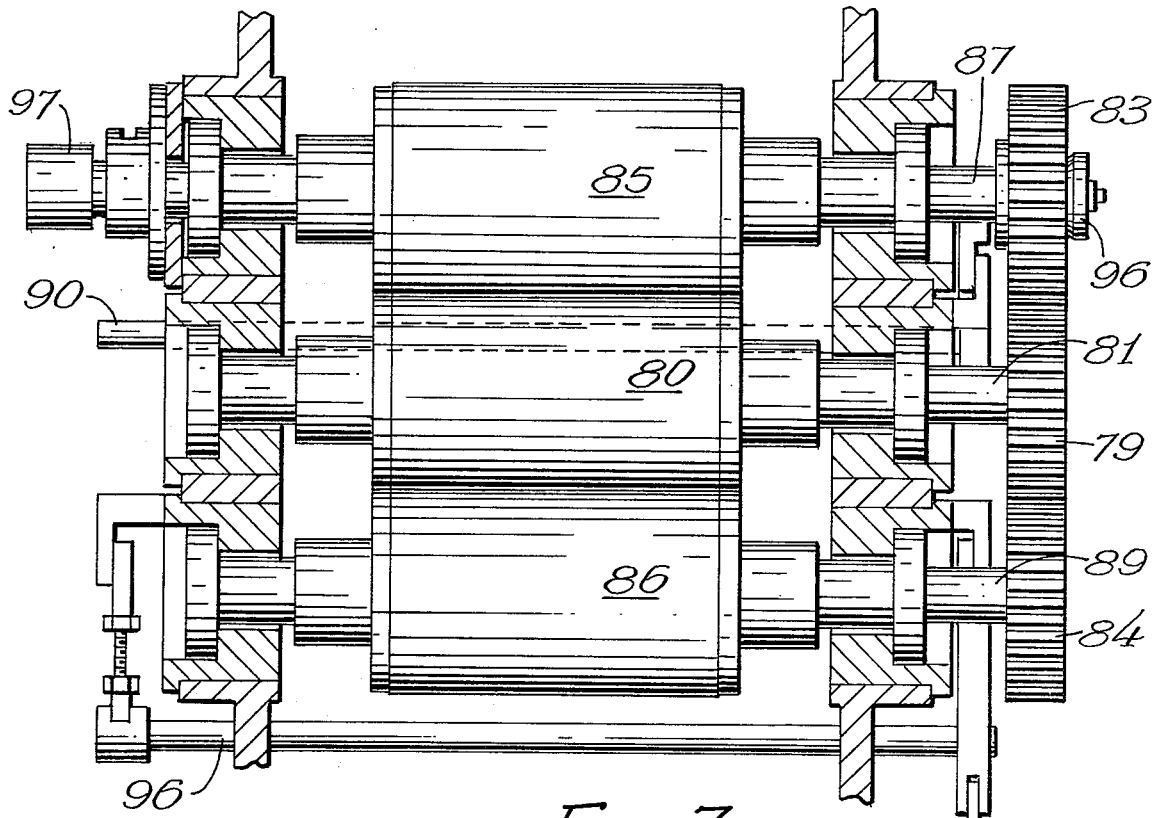
FIG. 7 is a diagrammatic section of the frame showing the mounting of the three cylinders in the fixed portion of the press.
Figure 6:
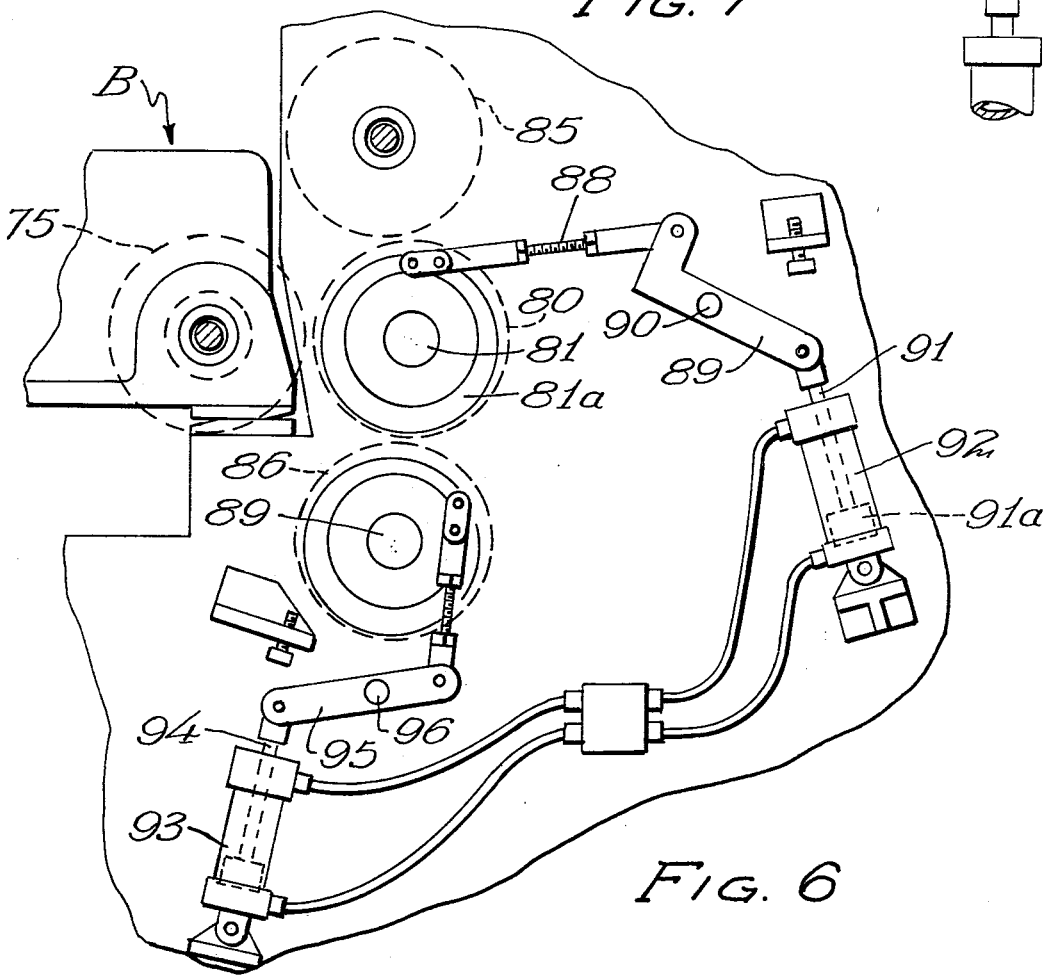
FIG. 6 is a diagrammatic elevational view showing the means for operating the cylinder release.
Figure 8:
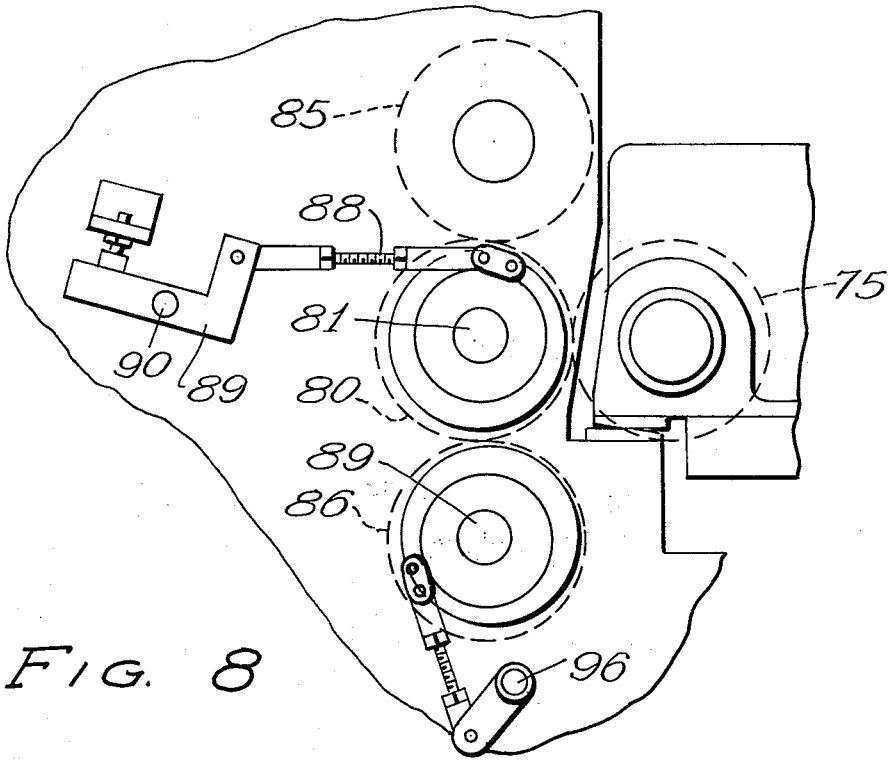
FIG. 8 is a diagrammatic view similar to FIG. 6 but on the opposite side of the frame, showing the cylinders in contact.
Figure 9:
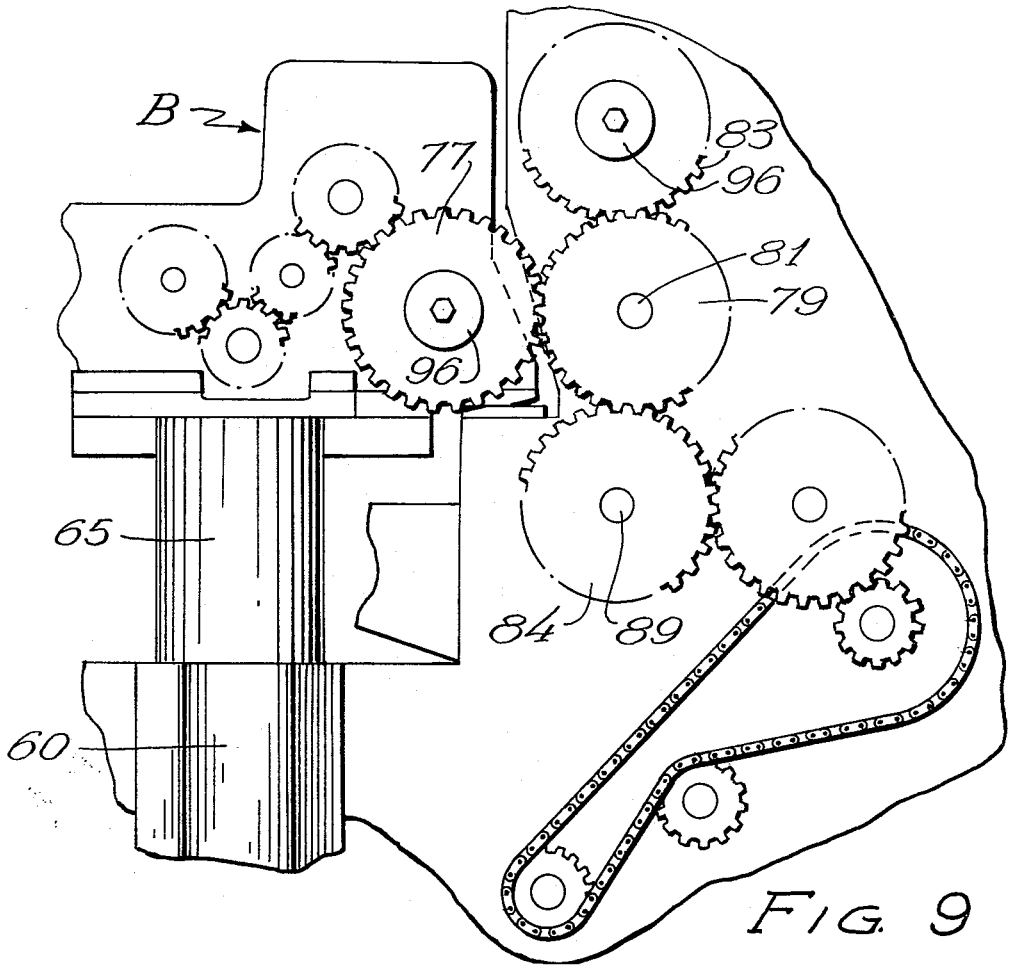
FIG. 9 shows the drive means operating the cylinders.

The blanket cylinder 80, as illustrated in FIGS. 6, 7, and 8, is mounted on a shaft 81, and the impression cylinder 86 is eccentrically mounted on a shaft 89. The blanket cylinder 80 is actuated by an adjustable arm 88 and a bellcrank 89 which is pivoted at 90 and which may be rotated in a counter clockwise direction about pivot 90 by a piston rod 91 connected to an air cylinder 92. When air cylinder 92 is activated, arm 88 rotates an eccentric support **81*a* in a counter clockwise direction moving blanket cylinder 80 against plate cylinder 85 and plate cylinder 75. Simultaneously, an air cylinder 93 is actuated forcing a piston rod 94 in a direction to pivot the lever 95 about its pivot 96 in a cloclwise direction. This draws the impression cylinder 86 (also eccentrically mounted) against the blanket cylinder 80. Pivots 90 and 96 extend through the machine to operate levers on both sides as shown in FIG. 8**.

Figure 11:
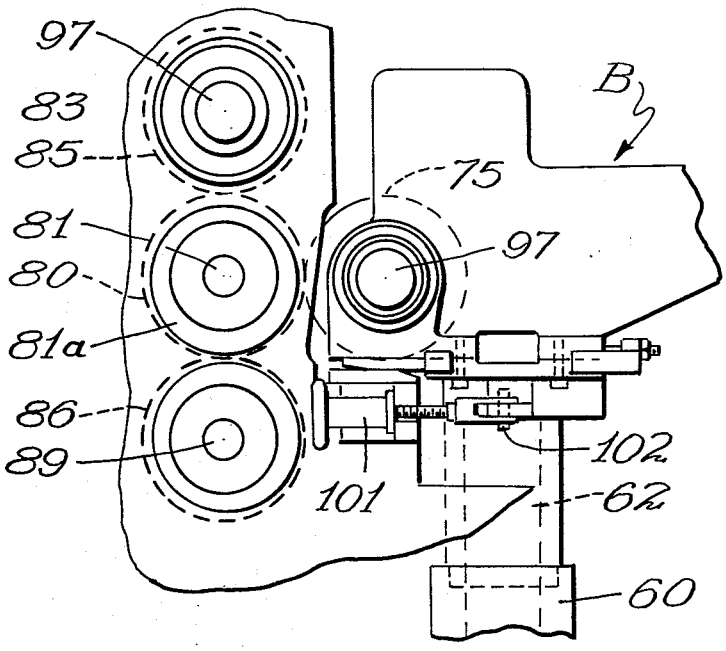
FIG. 11 shows a locking means for the embodiment of FIG. 4.
Figure 15:
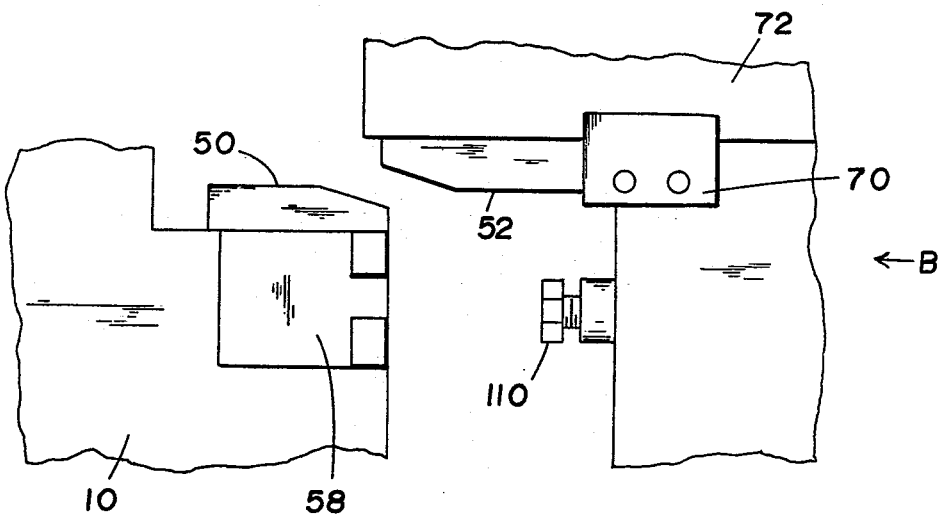
FIG. 15 is a detail view of the stop bolt adjustment structure.

FIG. 6 of the drawings shows the cylinders in nonoperative position, the cylinder 80 being out of contact with both the plate cylinder 85 and the impression cylinder 86. FIG. 8 shows the cylinders in contact as during operation. When the second color unit is in operation, cylinder 75 is rotated to also engage blanket cylinder 80. It is essential that cylinder 80 contact both plate cylinders 75 and 85 at the same time and with the same pressure to print both colors in the same way. Thus, it is clear that the moving frame must return to the exact same position every time it is opened and closed no matter how often this is done. To guarantee this, an adjustable stop bolt 110 is provided on movable unit B as shown in FIG. 15. Stop bolt 110 rests against the frame of the fixed portion of the press 10 just below the beveled bearing blocks 50 and 52. Stop bolt 110 determines the bear to bear distance between the cylinders so that an operator need not use the gears for this purpose. The units are then locked together either by the locking bar 54 of FIG. 3 or by a knurled locking screw 101 of the type shown in FIG. 11. To avoid the jar of moving beveled block 52 on or off beveled block 50, which would cause spillage and wear on the beveled blocks, the pivot axis may be slightly tilted as described in FIG. 16.

Figure 16:
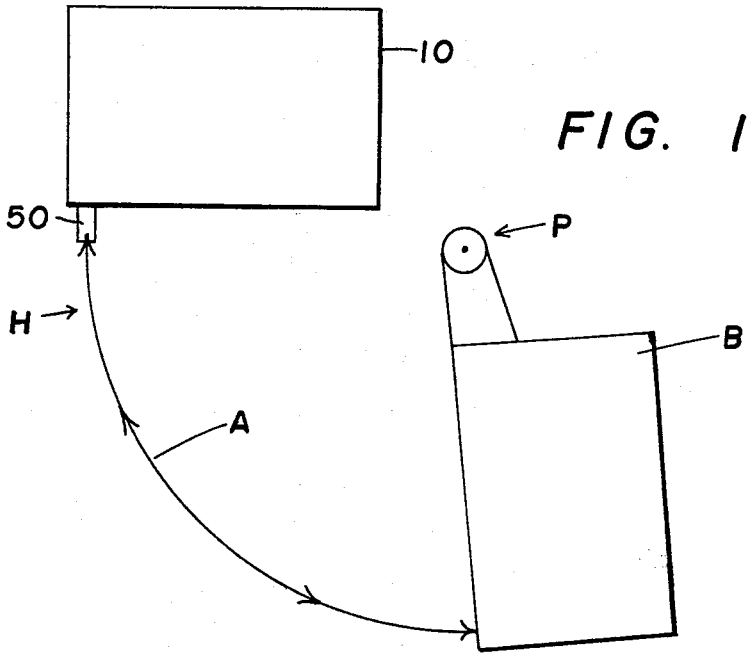
FIG. 16 is a schematic diagram showing the effect of the tilt of the pivot axis.

In FIG. 16 the fixed portion of the press is schematically shown by rectangle 10 while the swing away unit is shown by rectangle B. The pivot axis P is tilted from vertical slightly so that the end of unit B remote from pivot axis P rises and falls as it follows the arcuate path A. The tilt is away from point H so that B reaches its highest point at about point H and then begins to lower gently onto beveled block 50 thus avoiding any bounces or jars. Accordingly, there is no wear on blocks 50 and 52 and vertical registration is preserved with great accuracy.

Figure 12:
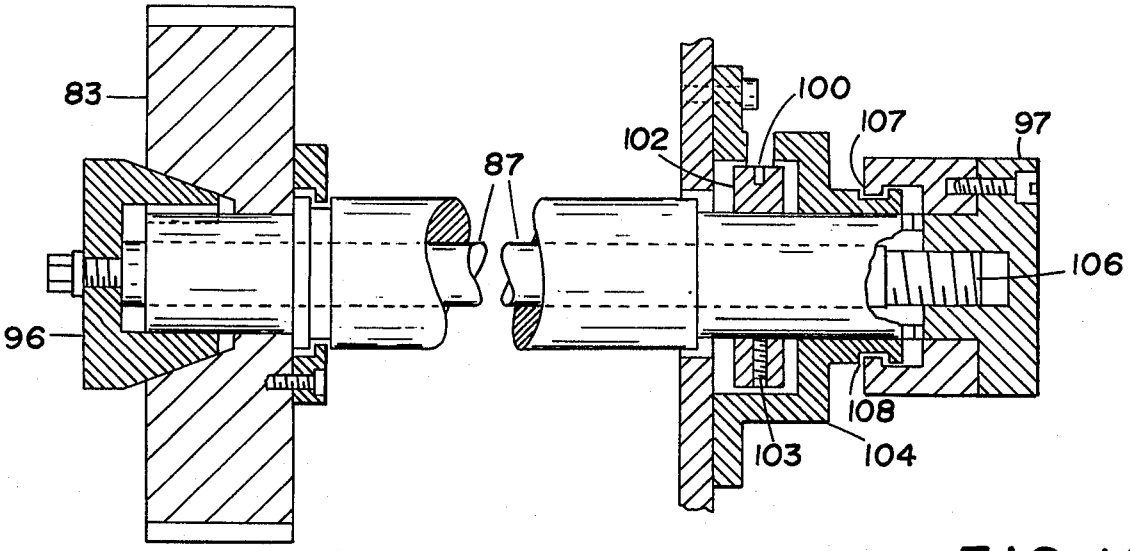
FIGS. 12 to 14 show the gear prealignment mechanism.
Figure 14:
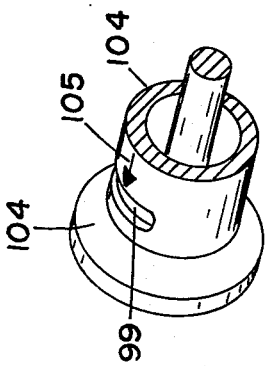
Figure 13:
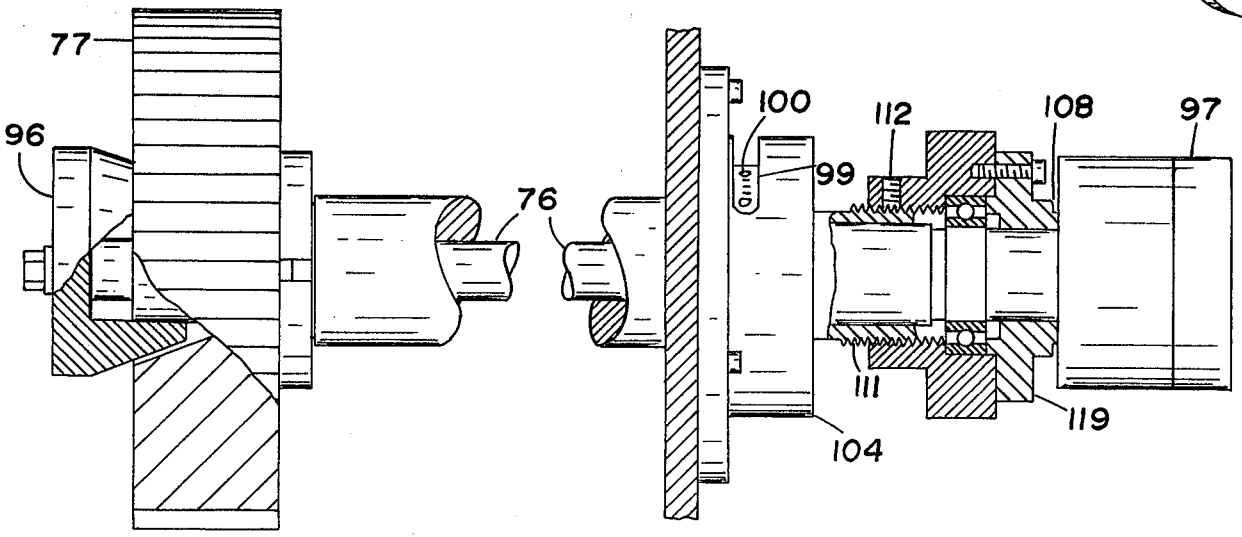

FIGS. 12 to 14 show the gear prealignment mechanism which permits the gears to be positioned for correct engagement even though the gears are not visible to the operator as the press is closed. The mechanism may be used on the fixed plate cylinder shaft 87 (FIG. 12) and the swing away plate cylinder shaft 76 (FIG. 13). Mounted to shafts 76 and 87 are discs 102 secured by screws 103. Discs 102 have a series of wrench holes 100 about their peripheries so that the operator can insert a small wrench through an arcuate slot 99 in a cover 104 into the holes 100 to rotate the shafts. A series of graduated marks on the disc periphery corresponding to the position of the teeth on gears 77 and 83 are aligned with an arrow 105 so as to prealign the gears for engagement. If the gear teeth need to be aligned with the discs 102 first, the operator may loosen a cone shaped clutch 96 from the gears 77 or 83 by unscrewing a cap 97 from the threaded end 106 of the shaft, rotate the cylinder relative to the gear and retighten cap 97. Caps 97 have hooks 107 which bear against grooves 108 in frame mounted members 104 and 119. In the case of the swing-away cylinder, member 119 is threadably engaged on cover 104 by threads 111 to permit lateral adjustment of shaft 76 and the cylinder thereon. Threads 111 may be locked in place with a set screw 112.

Clearly much of the structure of my invention could be modified without departing from the spirit and scope of the invention. For example, cone clutches 96 could be eliminated or replaced by other types of clutches, adjustment caps 97 could be replaced by other adjustment structure, discs 102 could be replaced by different shaped indicators, support table 65 could assume a revised shape, and other changes could be made. Accordingly, I intend to be bound only by the appended claims.

I claim:

1. A printing press for printing multiple color designs comprising in combination: a base; a fixed frame on said base adapted to carry an ink supply system, a plate cylinder support shaft with a plate cylinder thereon, a blanket cylinder support shaft with a blanket cylinder thereon, an impression cylinder, and a drive system therefor; a vertical pivot axis support on said base adapted to carry a moving frame in pivoting relation about said pivot support, said moving frame adapted to carry an ink supply roller system and a second plate cylinder support shaft with a second plate cylinder thereon with the rotational axes of the ink supply roller system and second plate cylinder perpendicular to said vertical pivot axis so that the second plate cylinder can be pivoted into contact with said blanket cylinder so as to permit multiple color printing; a first gear on the end of the blanket cylinder support shaft closest to the pivot support; a second gear on the end of the second plate cylinder support shaft closest to the pivot support in position to engage said first gear when the second plate cylinder is pivoted into contact with the blanket cylinder; and rotational gear tooth position indicating means connected to the ends of the plate cylinder support shafts at the ends furthest from the pivot support to allow prealignment of the teeth on the first and second gears before engagement said rotational position indicating means comprising an index mark on the cylinder support structure and at least one disc mounted on a plate cylinder support shaft, said disc having wrench holes therein to permit the disc and cylinder to be rotated and a series of graduated marks about the periphery of the disc corresponding to the position of the gear teeth.

2. The press of claim 1 including beveled positioning blocks on said fixed and moving frame operable to come into horizontal facing contact on closure of the press so as to accurately position the two frames relative to each other vertically.

3. The press of claim 2 in which said pivot axis is tilted from vertical with the upper portion of the pivot axis moved away from a first point in space proximate said beveled block on said fixed frame causing the moving frame to swing through an arc which rises and falls relative to said fixed frame so as to raise the moving frame up just before said beveled blocks come into contact and prevent hard collisions between the beveled blocks when the press is closed.

4. The press of claim 3 including an adjustable length stop bolt mounted on said press in position between said fixed frame and said moving frame to set the minimum distance between the fixed and moving frames.

5. The press of claim 1 in which the plate cylinder shafts are connected to their drive gears by clutch means to permit rotational adjustment of said discs relative to said gears.

6. The press of claim 5 including beveled positioning blocks on said fixed and moving frame operable to come into horizontal facing contact on closure of the press so as to accurately position the two frames relative to each other vertically.

7. The press of claim 6 in which said pivot axis is tilted from vertical with the upper portion of the pivot axis moved away from a first point in space proximate said beveled block on said fixed frame causing the moving frame to swing through an arc which rises and falls relative to said fixed frame so as to raise the moving frame up just before said beveled blocks come into contact and prevent hard collisions between the beveled blocks when the press is closed.

* * * * *